US007600338B2

(12) United States Patent
Geissele

(10) Patent No.: US 7,600,338 B2
(45) Date of Patent: Oct. 13, 2009

(54) MULTI-STAGE TRIGGER FOR AUTOMATIC WEAPONS

(76) Inventor: William H. Geissele, 603 Caroline Dr., Norristown, PA (US) 19401

( * ) Notice: Subject to any disclaimer, the term of this patent is extended or adjusted under 35 U.S.C. 154(b) by 0 days.

(21) Appl. No.: 12/009,553

(22) Filed: Jan. 17, 2008

(65) Prior Publication Data

US 2009/0183414 A1 Jul. 23, 2009

(51) Int. Cl.
*F41A 3/00* (2006.01)

(52) U.S. Cl. ..... 42/69.03; 89/139; 89/140

(58) Field of Classification Search ..... 42/69.03
See application file for complete search history.

(56) References Cited

U.S. PATENT DOCUMENTS 5,501,134 A * 3/1996 Milazzo et al. ..... 89/139
6,131,324 A * 10/2000 Jewell ..... 42/69.03
6,615,527 B1 * 9/2003 Martin ..... 42/69.03
6,772,548 B1 * 8/2004 Power ..... 42/69.03
7,331,136 B2 * 2/2008 Geissele ..... 42/69.03
2006/0086031 A1 4/2006 Geissele
2007/0266845 A1 * 11/2007 Polston ..... 89/139

* cited by examiner

*Primary Examiner*—Michael Carone
*Assistant Examiner*—Samir Abdosh

(57) ABSTRACT

A two-stage trigger assembly for the M16 or AR15 weapon systems. The trigger assembly comprises a spring loaded hammer, trigger and disconnector. Calibrated springs are provided to facilitate the adjustment of the second stage trigger pull weight. No set screws adjustments are necessary and a secondary safety sear similar to the factory original fire control components has been incorporated to prevent the unintentional mechanical discharge of the firearm. Installation of the disclosed device is identical to the factory fire control group and requires no hand fitting.

9 Claims, 9 Drawing Sheets

FIG.3
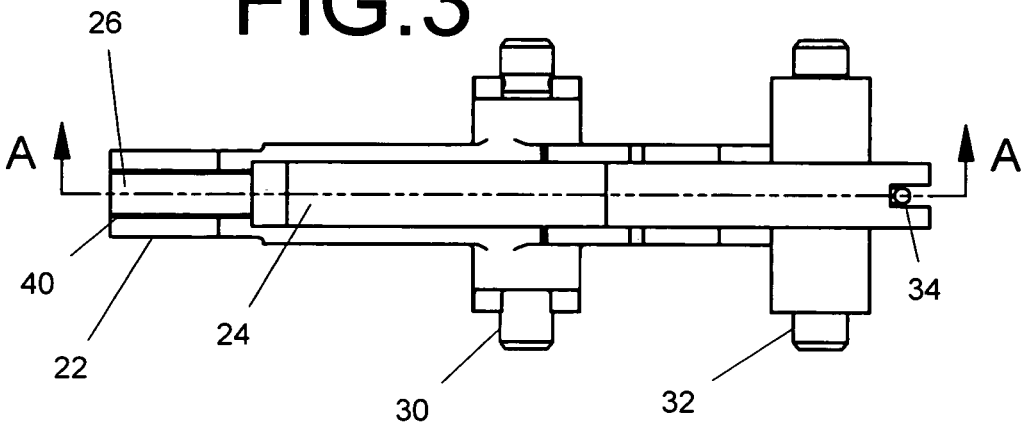
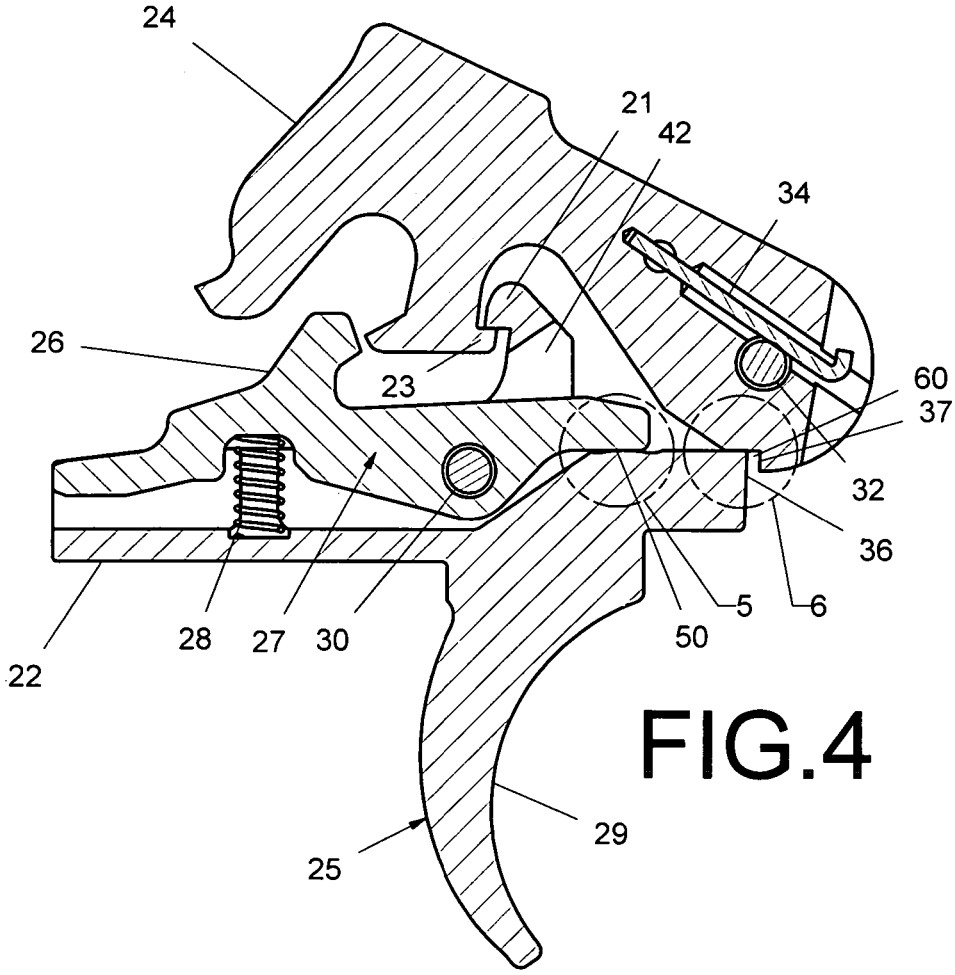
FIG.4

MULTI-STAGE TRIGGER FOR AUTOMATIC WEAPONS

BACKGROUND OF THE INVENTION

1. Field of Invention

This application relates in general to two-stage trigger systems with improved safety and manufacturability features for semi-automatic weapons and specifically to the use of said trigger assembly on an AR-15 type rifle.

2. Prior Art

The trigger assembly of the proposed invention was designed to increase the control an individual shooter has over the timing of the host firearms discharge of a round and thereby effectively increase the accuracy potential of a shooter by minimizing mechanical distractions which hinder accurate gun fire. A smooth crisp trigger is essential if the user is to control when the firearm discharges. Precision shooters, be they military, law enforcement or civilian competitors require total control of the trigger mechanism to attain the maximum accuracy potential of their rifle. For military and law enforcement precision shooters control over the trigger mechanism is essential to the success of their respective missions.

Under optimal conditions a shooter wants to use as little force as is necessary to discharge his firearm. By minimizing the force necessary to manipulate the trigger group and thereby discharge the firearm the potential for pulling the firearm off target while manipulating the trigger is dramatically reduced. Lightening the trigger is an obvious solution to solving trigger related accuracy problems but concerns over safety must also be considered. Reducing the trigger pull weight also presents the potential for accidental or negligent discharges which can result in the loss of life, which is of particular concern to law enforcement and military end users.

Two stage triggers, which are well known in the prior art, allow for a smooth first stage and a light, crisp second stage which results in the firearm being discharged after the resistance is overcome. Two-stage triggers address many of the safety concerns which are present with light weight single stage triggers. Unfortunately many existing designs require the adjustment of set screws and/or the reduction of spring tension necessary to operate the hammer component of the trigger assembly. Set screws such as those found in U.S. Pat. No. 6,131,324 (Arnold W. Jewell) have a tendency to become threadedly unsecured after prolonged use. This often leads to a situation where the trigger either allows the uncontrolled discharge of the host weapon or prohibits the weapons from firing at all, this presents an obvious safety problem and concern for the user of a firearm equipped with such a trigger. A design which provides a smooth, crisp, and controlled trigger pull without the need of set screws if highly desirable. The design disclosed in this document requires no set screws to adjust the trigger pull weight and incorporates several safety features to prevent negligent discharge of the firearm.

Designs such as Rock River Arms two stage trigger rely on similar trigger disconnector geometry as found on factory AR15 or M16 triggers. These designs have a flat surface to surface contact which in the case of a pivoting component contacting another stationary component a flat surface to surface contact is extremely difficult to achieve as any deviation from perfect component size will in fact cause the two surfaces to not sit flat to each other thereby negatively affecting the primary sear engagement thus affecting the trigger pull weight. Any inconsistency between these two flat surfaces will dramatically and negatively affect the trigger mechanism as a whole. By providing a non linear surface with a partial radius on the trigger a line contact between the flat face of the disconnector and the partial radius on the trigger is provided, not a flat surface to flat surface contact. An another embodiment of the design could place the radius onto the disconnector face with the trigger surface being flat, the end result would be the same. With a flat surface contacting a cylindrical surface any differences in component size or position from 'perfect' will still allow the intended line contact at a point near where intended. This is a key aspect to providing a production two stage trigger which has a consistent, reliable trigger pull between each article of manufacture without the need of adjustable set screws or hand fitting.

While other designs such as those disclosed in U.S. Pat. No. 6,131,324 (Arnold W. Jewell) and U.S. Pat. No. 5,501,134 (Milazzo) require the adjustment of problematic set screws to adjust trigger pull weight the novel design described herein has incorporated another solution. Through the use of calibrated disconnector springs the trigger pull weight may be lowered or increased. This change in no way affects the reliability or safety of the trigger. While designs such a disclosed in U.S. Pat. No. 5,501,134 (Milazzo) do offer lighter disconnector springs, adjusting the set screws is still necessary to ensure proper function of such designs.

A safety sear similar to the primary sear present on the factory M16 or AR15 trigger group is also present. Many available triggers on the market do not have a secondary safety sear which would prevent the firearm from discharging should the primary sear break. This is of particular concern if the firearm is loaded and the firing mechanism is in the operational or "cocked" position. My design has incorporated a safety sear which will catch the hammer and prevent the weapon from discharging even if the primary sear brakes.

The present invention greatly reduces the probability of accidental firearm discharge while at the same time providing the user of a firearm appropriately equipped with desired trigger action characteristics. Shot to shot consistency of pull weight and travel is insured without abnormal manipulation or motion between shots.

Another improvement over other two stage triggers is the use of a precision sheet metal fabrication for the disconnector. The original M16 disconnector is manufactured by fineblanking which is a sheet metal stamping operation that will produce a part to close tolerances and fine surface finish on the edges of the part. Current two stage triggers that locate the primary sear above the trigger pin use investment castings or machined from solid metal disconnectors. Investment casings and machined disconnectors usually cost more per piece than an equivalent fineblanked or laser cut disconnector that is made from sheet metal. A sheet metal disconnector that is carried in the conventional M16 manner can be made to properly interface with a select-fire M16 safety selector so that a two stage trigger capable of fully automatic fire may be easily designed. The current invention carries a sheet metal disconnector in a trough that is located in the trigger in a manner similar to the original M16 disconnector. However, where the original M16 disconnector is located in an open trough whereas the current invention covers over part of the trough with a structure that carries the two stage trigger primary sear. This structure has an aperture or void that allows the disconnector to pass through the structure so that the disconnector stop may be located forward of the trigger pin.

OBJECTS AND ADVANTAGES

Accordingly several objects and advantages of the present invention are (a) To provide a trigger mechanism which has no threadedly secured adjustment points.

(b) To provide a trigger mechanism that does not require modification of the receiver or trigger mechanism to function in an AR15 or M16 based weapon system.

(c) To provide a secondary safety sear that will prevent the hammer from falling if the trigger is not pulled and/or the primary sear fails.

(d) To provide a non linear stop for the disconnector which is machined onto the trigger to minimize the effect foreign particles might have on the trigger pull weight and to provide consistent sear engagement between each article of manufacture.

(e) To provide an improved trigger mechanism that requires no fitting or adjustment by the user.

(f) To provide a trigger mechanism that is easy and cost effective to manufacture by the use of a sheet metal disconnector.

Still further objects and advantages will become apparent from a consideration of the ensuing description and drawings.

SUMMARY

In general terms the present invention provides two stage trigger mechanism consisting of a spring loaded trigger, hammer, and disconnector. No adjustment or hand fitting is required for the installation of the presented invention, a feature that sets it apart from many other existing designs.

Specifically my device affords several advantages over other existing designs. There are no set screws which may become threadedly unsecured rendering the trigger inoperable. A secondary safety sear has been included to prevent a negligent discharge should the primary sear fail for an unforeseen reason. A non linear stop has been provided for the disconnector to facilitate a consistent trigger pull weight even after prolonged use and the accumulation of debris associated with the use of a firearm. A simple, robust sheet metal disconnector is also provided that is easy and cost effective to manufacture.

A method of installation has been afforded the users of this device which requires no modification of the receiver or of the trigger assembly such as required by the design disclosed in U.S. Pat. No. 5,501,134 (Milazzo). Further the proposed novel trigger mechanism installs exactly like the factory original trigger mechanism.

While the proposed apparatus is designed for the AR15/M16 weapons system this should not be seen as a limitation of the overall application and potential use of the technology disclosed in the application.

DRAWINGS

The novel features believed to be characteristic of the invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended as a definition of the limits of the invention.

FIG. 3 shows a top view of the proposed trigger;

FIG. 4 shows an internal, side view of the proposed trigger mechanism;

DETAILED DESCRIPTION OF THE PREFERRED EMBODIMENT

Figure 1:
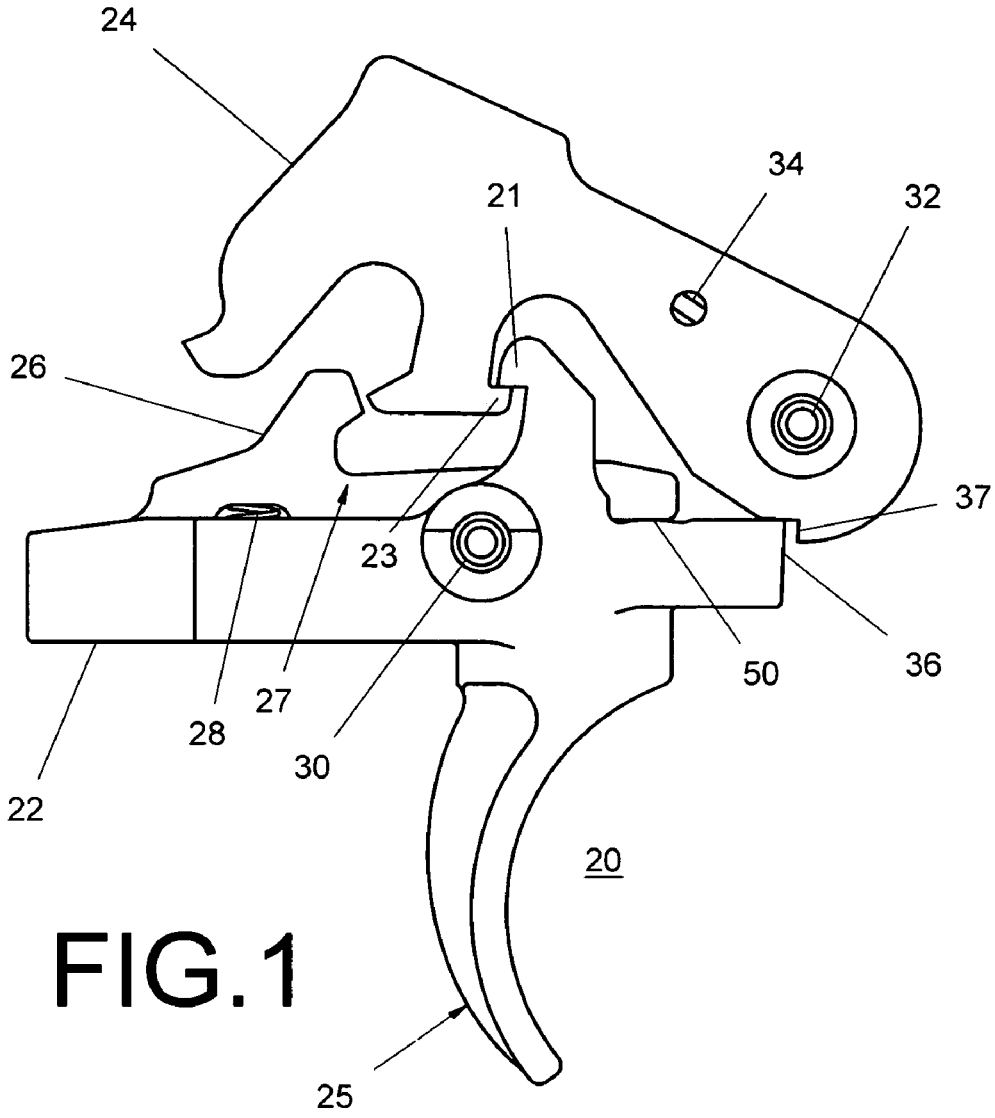
FIG. 1 shows a side view of the trigger mechanism, where the hammer is in the cocked position.

Turning now to the drawings in which like reference characters indicate corresponding elements throughout the several views, as used herein, the word "front" or "forward" corresponds to the end of the trigger assembly where the safety sear is located (i.e., to the right as shown in FIGS. 1, 2, 3, 4); "rear" or "rearward" or "back" corresponds to the direction opposite the end of the trigger assembly where the safety sear is located (i.e., to the left as shown in FIGS. 1, 2, 3, 4).

Figure 2:
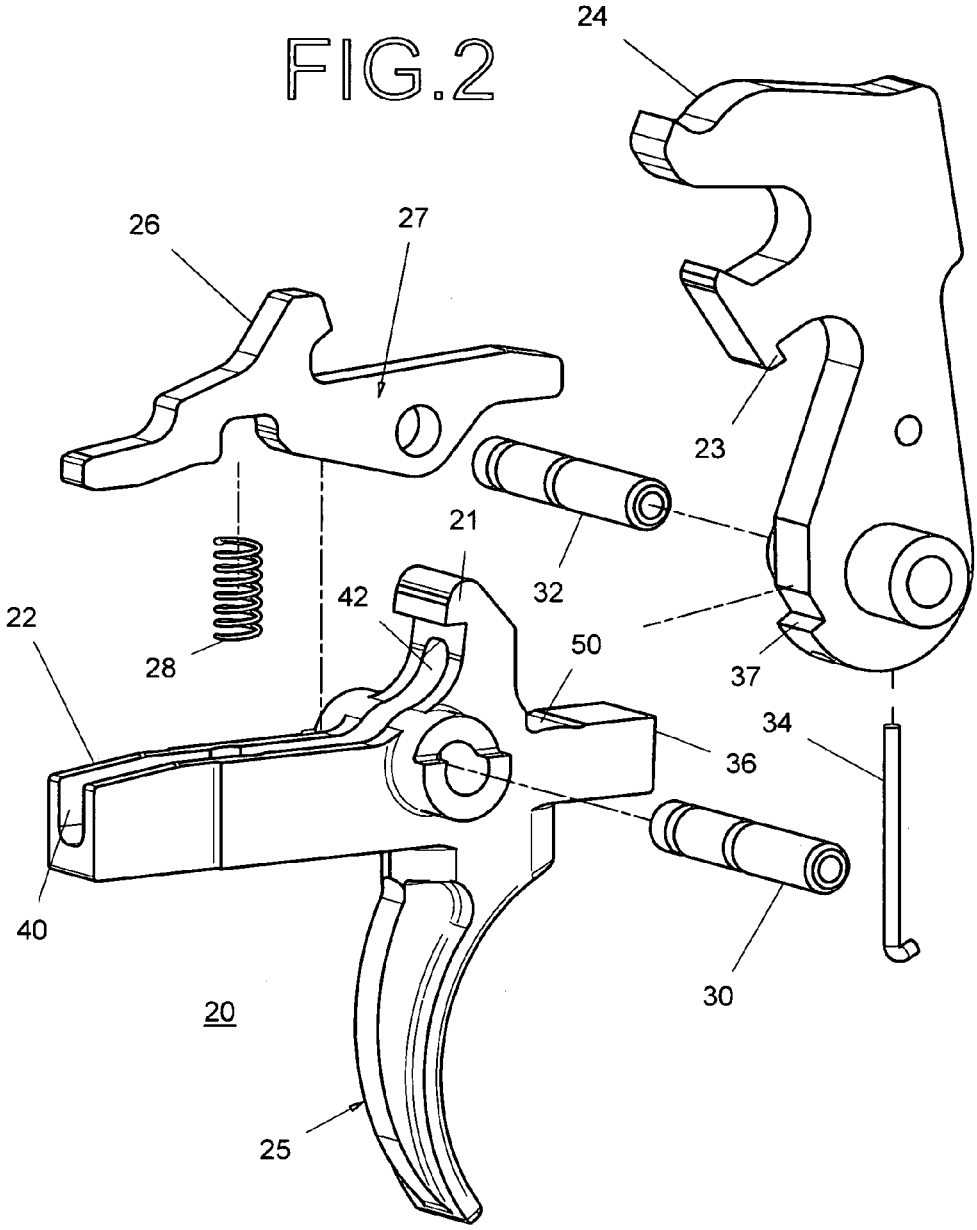
FIG. 2 shows an exploded, three dimensional view of the present invention and how it is assembled.

Attention is first directed to FIG. 1 which illustrates the trigger mechanism, generally designated 20 and FIG. 2 which is an exploded view of the trigger mechanism 20 of FIG. 1. It will be understood that trigger mechanism 20 is intended to be employed with any of the various M16 type firerms; however with minor modifications it could be more widely used for other firearms as well. M16 type firearms include the AR15 family of rifles, the M4 carbine family of rifles, the SR25 and AR10 larger caliber type M16 rifles and other rifles that use the AR15 trigger assembly. It will also be understood that trigger mechanism 20 is carried by a lower receiver of a firearm. A lower receiver is not shown, as they are well known in the art and trigger mechanism 20 is carried in the conventional manner using trigger pin 30 and hammer pin 32. Trigger mechanism 20 has a spring loaded trigger assembly 22 having a trigger sear hook 21 and a spring loaded hammer 24 having a hammer sear hook 23. The trigger assembly spring and hammer spring are omitted for clarity. Trigger assembly 25 includes a trigger 22, spring loaded disconnector assembly 26. The trigger assembly 25 is pivotally connected to trigger pin 30 that passes from one side of trigger 22 through disconnector assembly 27 and through opposite side of trigger 22. In the cocked position shown in FIG. 1 the trigger sear hook 21 is fully engaged in hammer sear hook 23.

Referring to FIG. 2, disconnector assembly 27 includes a disconnector 26, disconnector spring 28. Trigger 22 has a nose 36 at one end and a trough 40 formed therein extending from the opposing end. Trough 40 includes a placement for disconnector spring 28. The trigger sear hook 21 is part of trigger assembly 25. There is an aperture 42 through the structure which incorporates the trigger sear hook 21. This aperture 42 allows the disconnector 26 to pass through and under the trigger sear hook 21 placing the disconnector 26 stop point forward of the trigger sear hook 21.

Turning to FIG. 3 which is a plan view of the trigger mechanism of FIG. 1, the trough 40 is clearly shown into which the disconnector assembly 27 resides.

Referring to FIG. 4 which is a sectional view of FIG. 3 on the line A-A the disconnector 26 pivots on a trigger pin 30 and bears on the surface of the trigger pivot pin 30. Hammer sear hook 23 and trigger sear hook 22 form the trigger and hammer engagement means. In the cocked position shown in FIG. 4 the hammer sear hook 24 is fully engaged in trigger sear hook 22. Pulling the trigger 29 causes the trigger 22 and disconnector assembly 27 to rotate about trigger pin 30 and pull the trigger sear hook 21 off the hammer sear hook 23. Disconnector spring 28 is removable from the trough 40 when trigger pin 30 is removed from trigger 22, this removable spring is the means for adjusting the amount of resistance which is required to overcome the disconnector 26 resistance. By allowing the user to vary the resistance of spring 28 the force imparted to disconnector 26 may be varied.

Figure 5:
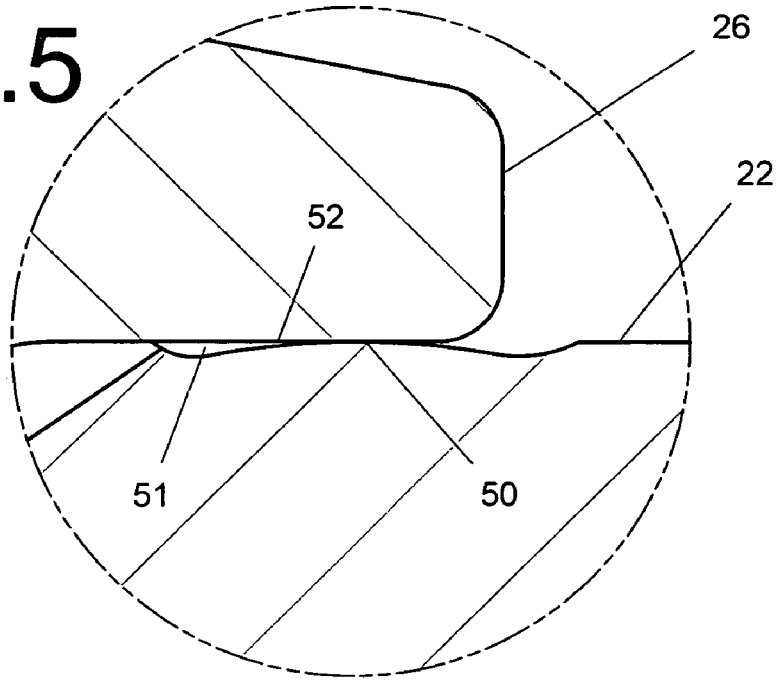
FIG. 5 shows details of the non-linear disconnector stop and the disconnector present on the proposed trigger assembly.

Additionally, FIG. 5 is an enlarged view of the non linear trigger stop 50. On the trigger 22 the non linear surface is a partial radius 51 while the disconnector contact surface 52 is flat. The partial radius 51 located on the trigger 22 is machined in such a way as to facilitate a line contact between the trigger 22 and the disconnector contact surface 52.

Figure 6:
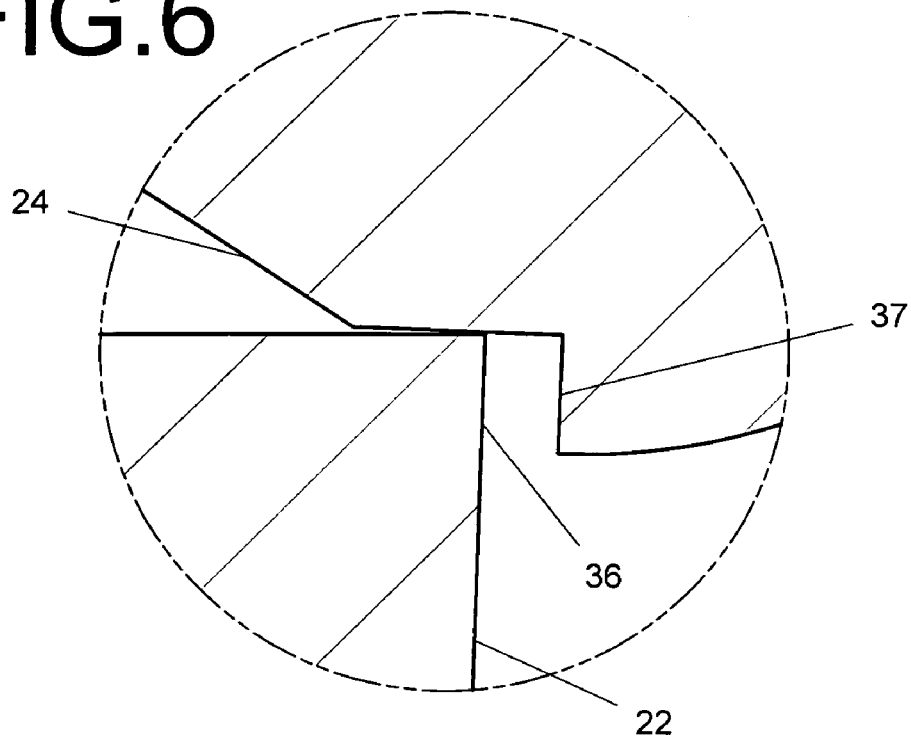
FIG. 6 shows details of the safety sear on the forward end of the trigger and how it interacts with the hammer catch.

Additionally, FIG. 6 is an enlarged view of the secondary safety sear 60, the nose 36 of the trigger 22 and the notch 37 of the hammer 24 form the means by which the secondary safety sear functions. In the event that trigger sear hook 21 or hammer sear hook 23 fail, the secondary safety sear which is a function of both notch 37 and nose 36 will prevent the hammer 24 from being activated by its associated spring. Spring for the hammer 24 was left out of illustration for reasons of clarity. The notch 37 and nose 36 each have opposing surfaces which will passively come into contact with each other without the trigger 29 being pulled rearward.

Figure 7:
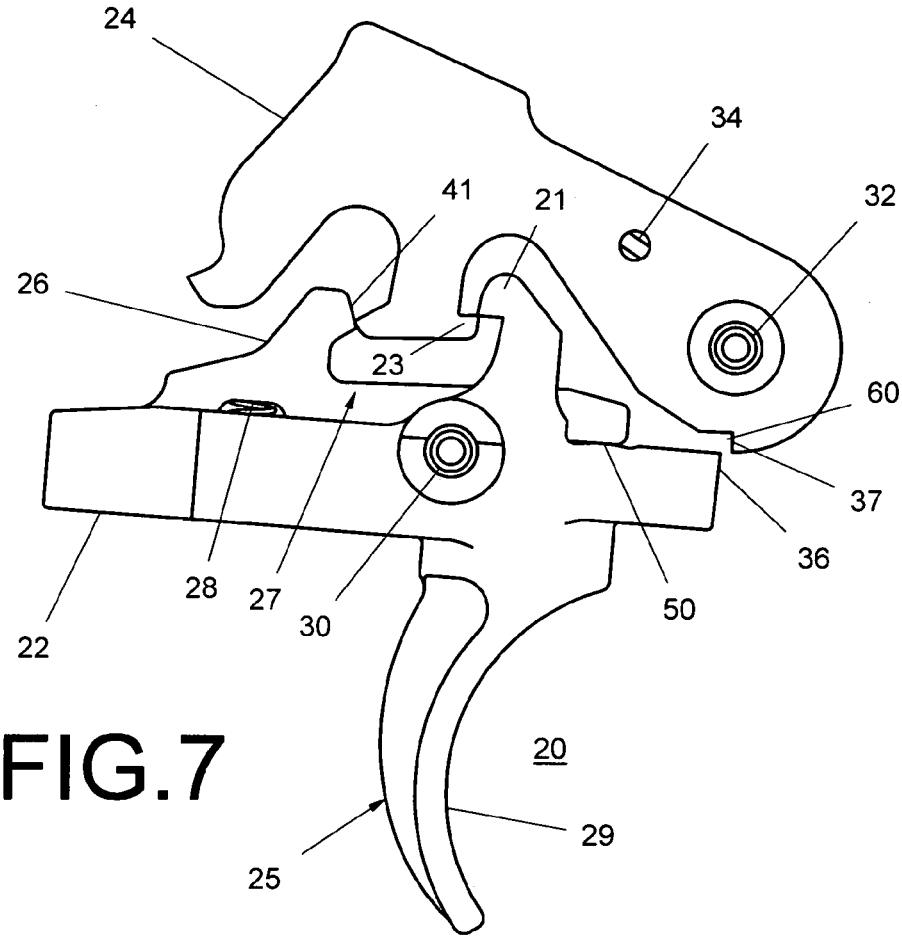
FIG. 7 shows details of how the triggers individual parts interact when in the cocked position.

Turning to FIG. 7, which is a side view of the trigger mechanism 20 where the trigger mechanism 20 is in a cocked position similar to FIG. 4 but with the trigger 29 pulled thereby rotating the trigger assembly 25 clockwise around trigger pivot pin 30 while overcoming resistance of a trigger spring that is not shown for clarity. In FIG. 6 the trigger 22 has been pulled until the hammer sear hook 23 has contacted disconnector face 41 of disconnector 26 and overlap of the hammer sear hook 23 and trigger sear hook 21 has been reduced. At this point in the process of pulling the trigger 29 the shooter will feel a distinct stop point where the secondary hammer sear hook 23 is attempting to rotate disconnector 26 around trigger pivot pin 25 in a counter-clockwise direction. The location of this stop point controls the amount of overlap left on the hammer sear hook 23 and trigger sear hook 21 and marks the end of the $1^{st}$ stage of trigger pull. A minimal amount of overlap is desired as only a slight amount of additional pressure on the trigger 29 will rotate the disconnector 26 counter-clockwise and allow the trigger sear hook 21 to slip off the hammer sear hook 23 thereby allowing the hammer 24 to rotate under the force of the hammer spring and strike the firing pin, discharging the firearm. This slight additional pressure on trigger 29 is known as the $2^{nd}$ stage and allows the shooter to carefully align his sights on target and at the appropriate moment the slight additional pressure on trigger 29 will allow the firearm to discharge without disturbing the alignment of the firearm sights. The removal and subsequent replacement of the disconnector spring 28 allows the user to adjust the amount of force necessary to rotate the disconnector 26 counter-clockwise thereby affecting the amount of resistance necessary to complete the $2^{nd}$ stage of the trigger pull 29.

Figure 8:
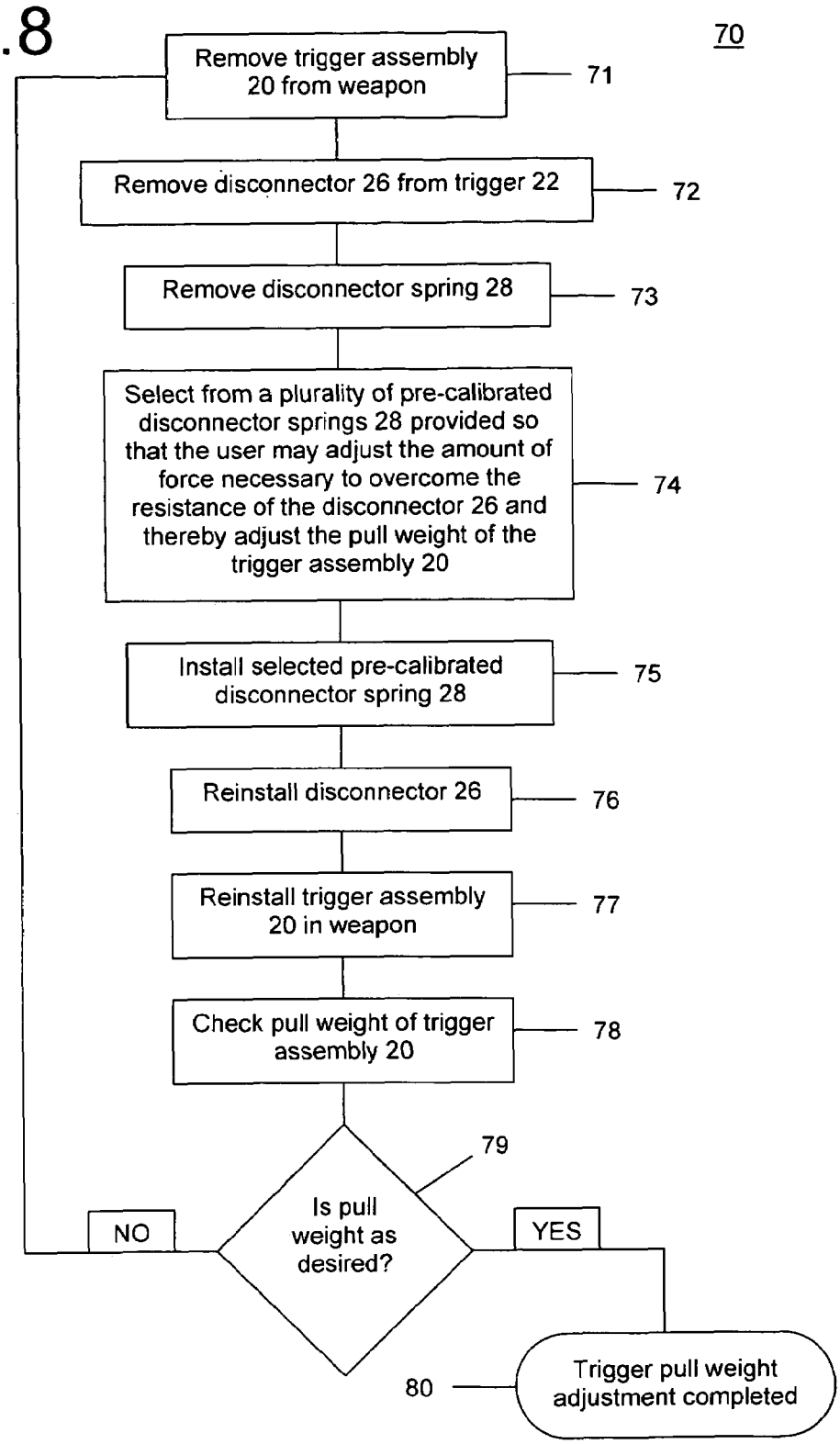
FIG. 8 shows a flow chart detailing the means by which the user may replace the weight calibrated disconnector springs.

Referring to FIG. 8, there is shown a flow diagram of a method 70 of replacement for the disconnector spring 28, thereby affecting the $2^{nd}$ stage trigger pull weight. Remove the trigger assembly 20 from the weapon 71. Remove 72 the disconnector 26 from the trigger 22. Remove 73 the disconnector spring 28 then select from a plurality of provided pre-calibrated springs 74 which will adjust the amount of force necessary to modify the weight of the $2^{nd}$ stage trigger pull which results in the discharge of the host firearm. Install 75 the selected disconnector spring 28. Reinstall 76 the disconnector 26 and trigger 77 assemblies 20 in weapon. Now the user needs to test 78 the trigger 29 pull weight and see if the pull weight is as desired if not then repeat the steps described on the disconnector spring replacement chart 70. If the trigger pull weight is as desired no further action need be taken 80.

Figure 9:
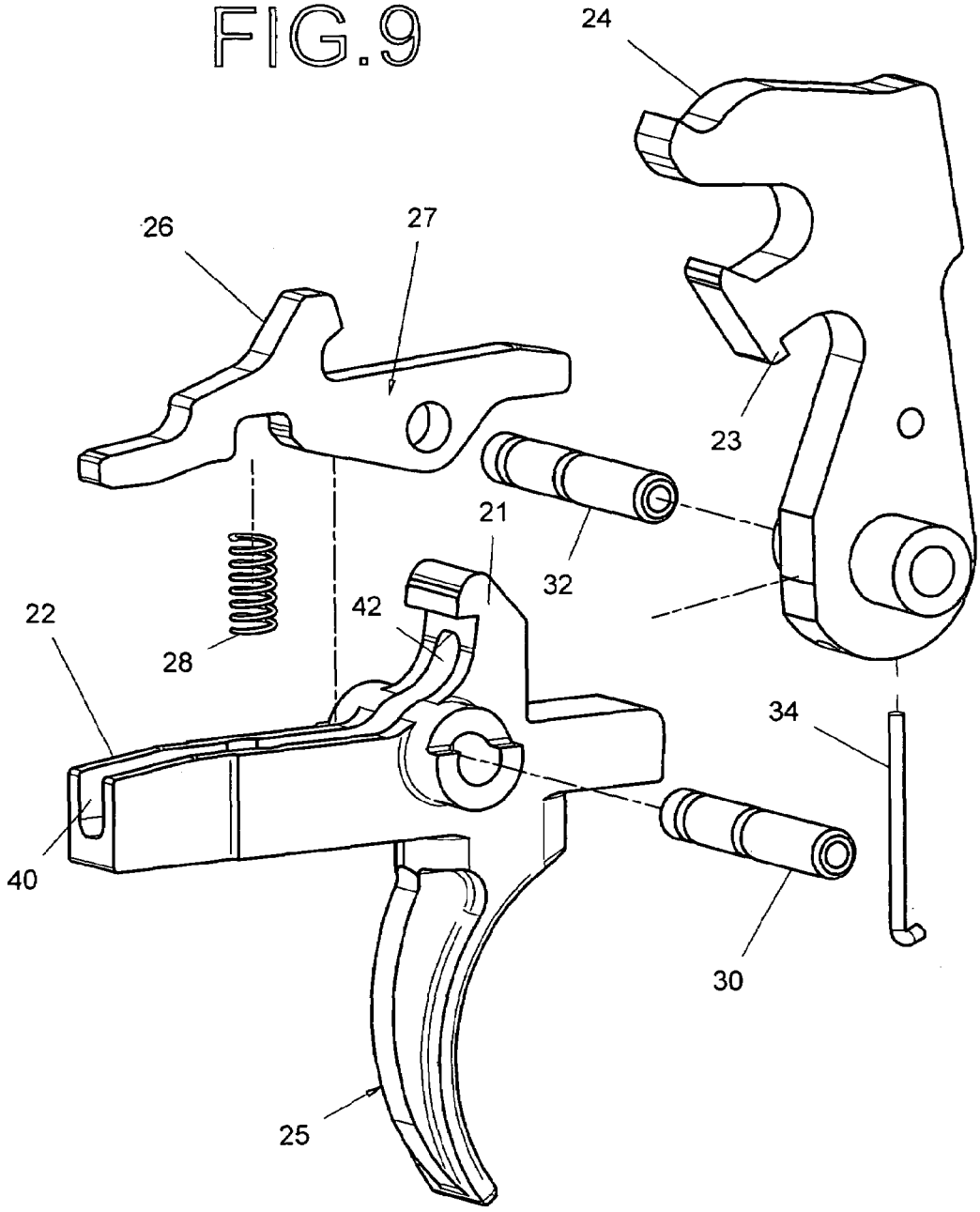
FIG. 9 shows an exploded, three dimensional view of an alternate embodiment of the invention and how it is assembled.

Referring to FIG. 9, there is shown an alternate embodiment of the present trigger assembly 20. The significant deviation from the preferred embodiment as illustrated and described in FIGS. 1 thru 8 are as follows. The secondary safety sear 60, nose 36 of the trigger 22, and the notch 37 of hammer 24, non linear stop 50, and partial radius 51 have been removed.

Figure 10:
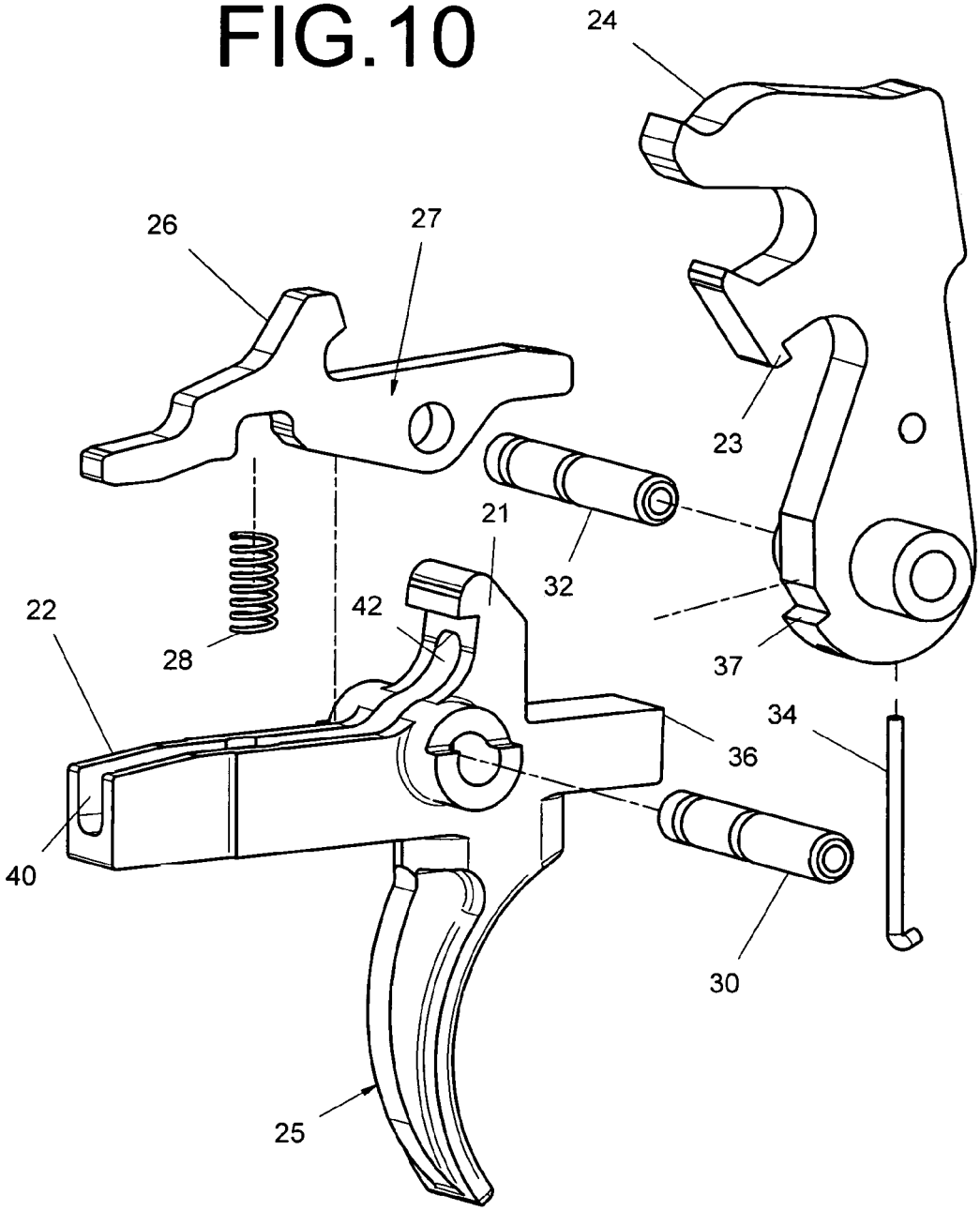
FIG. 10 shows an exploded, three dimensional view of an alternate embodiment of the invention and how it is assembled.

Referring to FIG. 10, there is shown an alternate embodiment of the present trigger assembly 20. The significant deviation from the preferred embodiment as illustrated and described in FIGS. 1 thru 8 are as follows. The non linear stop 50, and partial radius 51 have been removed.

Figure 11:
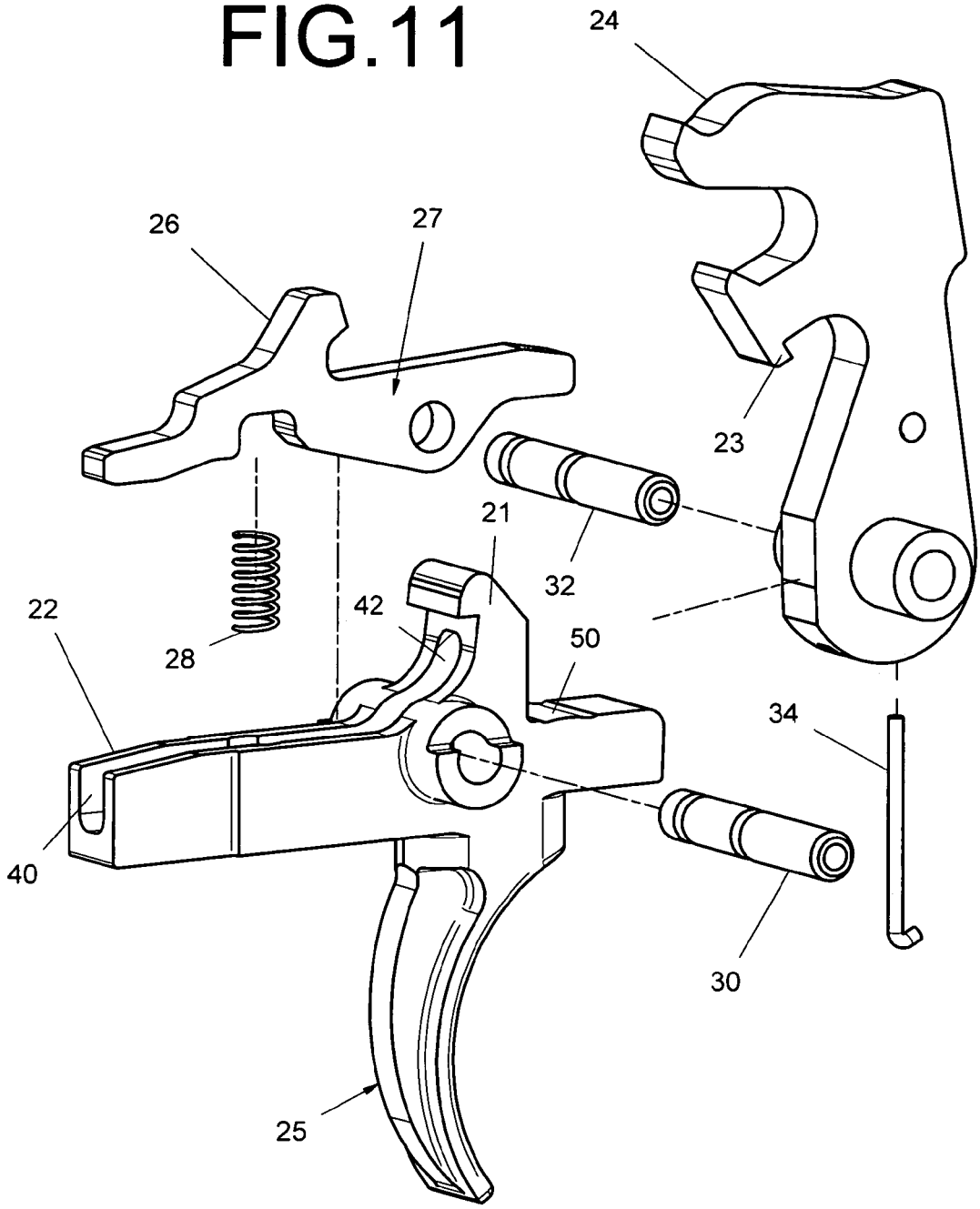
FIG. 11 shows an exploded, three dimensional view of an alternate embodiment of the invention and how it is assembled.

Referring to FIG. 11, there is shown an alternate embodiment of the present trigger assembly 20. The significant deviation from the preferred embodiment as illustrated and described in FIGS. 1 thru 8 are as follows. The secondary safety sear 60, nose 36 of the trigger 22, and the notch 37 of hammer 24 have been removed.

CONCLUSION, RAMIFICATIONS, AND SCOPE

Accordingly the reader will see that, according to the invention, I have provided a two stage trigger system with improved safety features, reliable pull weights, and a device which is durable. I have afforded the user of my device a means to adjust the $2^{nd}$ stage of my triggers pull weight without the need of problematic, adjustable screws. I have even provided a secondary safety sear to afford a military or law enforcement operator added safety when working in close confines with team mates.

While my above drawings and description contain many specificities, these should not be construed as limitations on the scope of the invention, but rather as an exemplification of one preferred embodiment thereof. The omission of the calibrated disconnector springs will not depart from the essential nature of the proposed invention. Further an embodiment of the invention may be had which omits the secondary safety sear and/or the partial radius located on either the trigger or disconnector contact surfaces. Accordingly, the scope of the invention should be determined not by the embodiments illustrated, but by the appended claims and their legal equivalents.

The invention claimed is:

1. A multi-stage trigger for automatic weapons, the multi-stage trigger for automatic weapons assembly comprising:

a. a spring loaded trigger, a spring loaded disconnector and a spring loaded hammer;

b. the trigger being pivotally connected to a firearm and the disconnector;

c. said trigger having a structure which incorporates a primary trigger sear and a aperture through said structure for said disconnector to operate;

d. a disconnector stop located at the fore end of said trigger has a partial radius which allows the surface of said disconnector to contact during normal operation;

e. the hammer being pivotally connected to the firearm f. said trigger having a pulling surface for the shooter to pull said trigger and said trigger and said hammer each including an engagement means for engaging each other so that said hammer is held in a cocked position prior to said trigger being actuated;

g. said trigger and hammer have a means to interact and prevent said hammer from rotating enough to discharge the firearm should a primary trigger sear be disengaged from a primary hammer sear without said trigger being pulled to the rear;

h. said disconnector being pivotally connected to the trigger, said disconnector having a contact means and having a removable disconnector spring for holding said disconnector in a predetermined position until sufficient force is applied to overcome the resistance of said disconnector spring;

i. a means to adjust the resistance of the disconnector spring;

j. said hammer further including a contact means for contacting said disconnector contact means so that when said trigger is first pulled the contact means contacts said disconnector and increases the pressure required to pull said trigger completely and disengage the engagement means of said hammer and said trigger.

2. A multi-stage trigger for automatic weapons of claim 1, wherein said disconnector stop radius is 0.750" with said disconnector being pivotally connected to said trigger in such a way as to allow said disconnector to stop on said radius.

3. A multi-stage trigger for automatic weapons of claim 1, wherein said means to adjust the resistance of said disconnector spring includes removable springs which are calibrated for specific resistance and thereby affect the amount of force necessary for said trigger to overcome the resistance of said disconnector thereby releasing the engagement means of said hammer and said trigger.

4. A multi-stage trigger for automatic weapons of claim 1, wherein said disconnector spring only affects the pull weight of said trigger when the resistance felt on said trigger is a result of attempting to overcome the disconnector engagement means.

5. A multi-stage trigger for automatic weapons of claim 1, wherein said structure is located at the fore end of the trigger assembly with a centrally located aperture through said structure which facilitates the movement of said disconnector.

6. A multi-stage trigger for automatic weapons of claim 2, wherein said disconnector stop partial radius of 0.750" is achieved through the use of electrical discharge machining.

7. A multi-stage trigger for automatic weapons, the multi-stage trigger for automatic weapons assembly comprising:

a. a spring loaded trigger, a spring loaded disconnector and a spring loaded hammer;

b. the trigger being pivotally connected to a firearm and the disconnector;

c. said trigger having a trough which houses said disconnector and having a trigger sear hook located near the front of said trigger which incorporates the primary trigger sear and an aperture through said trigger sear hook for said disconnector to operate, said aperture comprises an opening of sufficient size to allow the disconnector to fully traverse the length of the trigger sear hook aperture and exit the front side of the trigger sear hook;

d. the hammer being pivotally connected to the firearm;

e. said trigger having a pulling surface for the shooter to pull said trigger and said trigger and said hammer each including an engagement means for engaging each other so that said hammer is held in a cocked position prior to said trigger being actuated;

f. said disconnector being pivotally connected to the trigger, said disconnector having a contact means for interacting with the hammer to increase the pressure required to pull the trigger and having a disconnector spring for holding said disconnector in a predetermined position until sufficient force is applied to overcome the resistance of said disconnector spring, the forward portion of said disconnector is of sufficient length to pass fully through and exit said trigger sear hook aperture said disconnector has a contact means for contacting the front of the trigger during normal use;

g. said hammer further including a contact means for contacting said disconnector contact means so that when said trigger is first pulled the contact means contacts said disconnector and increases the pressure required to pull said trigger completely and disengage the engagement means of said hammer and said trigger.

8. A multi-stage trigger for automatic weapons, the multi-stage trigger for automatic weapons assembly comprising:

a. a spring loaded trigger, a spring loaded disconnector and a spring loaded hammer;

b. the trigger being pivotally connected to a firearm and the disconnector;

c. said trigger having a primary trigger sear which does not interfere with the operation of said disconnector;

d. said trigger and said disconnector contact surfaces have a partial radius placed on one surface so that a flat surface located to oppose said partial radius may pivot during normal operation;

e. the hammer being pivotally connected to the firearm f. said trigger having a pulling surface for the shooter to pull said trigger and said trigger and said hammer each including an engagement means for engaging each other so that said hammer is held in a cocked position prior to said trigger being actuated;

g. said disconnector being pivotally connected to the trigger, said disconnector having a contact means and having a disconnector spring for holding said disconnector in a predetermined position until sufficient force is applied to overcome the resistance of said disconnector spring;

h. said hammer further including a contact means for contacting said disconnector contact means so that when said trigger is first pulled the contact means contacts said disconnector and increases the pressure required to pull said trigger completely and disengage the engagement means of said hammer and said trigger.

9. A multi-stage trigger for automatic weapons, the multi-stage trigger for automatic weapons assembly comprising:

a. a spring loaded trigger, a spring loaded disconnector and a spring loaded hammer;

b. the trigger being pivotally connected to a firearm and the disconnector;

c. said trigger having a structure which incorporates the primary trigger sear and a void for said spring loaded disconnector to operate;

d. a disconnector stop located at the fore end of said trigger has a partial radius of 0.750", which allows the surface of the disconnector to pivot against during normal operation;

e. the hammer being pivotally connected to the firearm f. said trigger having a pulling surface for the shooter to pull said trigger and said trigger and said hammer each including an engagement means for engaging each other so that said hammer is held in a cocked position prior to said trigger being actuated;

g. said trigger has a forward ledge which will catch an angled indention located on the bottom surface of said hammer should the trigger sear or hammer sear be disengaged without the said trigger being pulled to the rear;

h. said trigger further includes a removable disconnector spring which is calibrated for a predetermined amount of resistance thereby affecting the amount of force necessary to pull said trigger by adjusting the amount of force which said disconnector exerts on the contact means of the trigger and hammer;

i. said disconnector being pivotally connected to said trigger, said disconnector having a contact means and having a spring for holding the disconnector in a predetermined position until sufficient force is applied to overcome the resistance of said spring;

j. said hammer further including at least one hook for engaging at least one disconnector leg so that when said trigger is first pulled the contact means contacts said disconnector and increases the pressure required to pull said trigger completely and disengage the engagement means of said hammer and said trigger.

* * * * *